US005279217A

United States Patent [19]

Ueda et al.

[11] Patent Number: 5,279,217

[45] Date of Patent: Jan. 18, 1994

[54] MIMEOGRAPHIC PRINTING MACHINE

[75] Inventors: Masahiro Ueda, Ibaraki; Kouichiro Iida, Ushiku, both of Japan

[73] Assignee: Riso Kagaku Corporation, Tokyo, Japan

[21] Appl. No.: 60,932

[22] Filed: May 13, 1993

[30] Foreign Application Priority Data

May 19, 1992 [JP] Japan ..... 4-126264

[51] Int. Cl.[5] ..... B41F 5/02

[52] U.S. Cl. ..... 101/2; 271/288; 101/90

[58] Field of Search ..... 101/2, 90, 232, 132; 271/288, 292, 296, 283

[56] References Cited

U.S. PATENT DOCUMENTS

| | | | |
|---|---|---|---|
| 3,788,221 | 7/1974 | Borneman | 101/132 |
| 3,894,733 | 7/1975 | Borneman | 271/283 |
| 4,181,078 | 1/1980 | Davis | 101/90 |
| 4,197,797 | 4/1980 | Rayfield et al. | 101/90 |
| 4,828,415 | 5/1989 | Hirono et al. | 104/232 |
| 4,831,553 | 5/1989 | Yoshino | 101/2 |

*Primary Examiner*—Eugene H. Eickholt

*Attorney, Agent, or Firm*—Kanesaka and Takeuchi

[57] ABSTRACT

A mimeographic printing machine equipped with a sorter for moving a plurality of bins to sort printed sheets, comprises: speed set-up means for setting up a desired print speed; sorter mode set-up means for setting up the sorter for the sort mode; and control means for changing the print speed, which is set up by the speed set-up means, to a predetermined print speed so as to conform to the sorting of the sorter, when the sort mode is set up in the sorter mode set-up means.

6 Claims, 4 Drawing Sheets

MIMEOGRAPHIC PRINTING MACHINE

BACKGROUND OF THE INVENTION

1. Field of the Invention

This invention relates to a mimeographic printing machine adapted to be connected with a sorter for sorting printed sheets, which is to be discharged out of the machine, orderly into a plurality of bins.

2. Description of the Related Art

Many of modern printers and copiers are equipped with a sorter for automatically sorting printed or copied sheets, which have been discharged out of the machine, into a plurality of trays (hereinafter called "bins").

For example, a small-size sorter to be used with a copier is combined with the copier body as an integral part of the copier; if the sorter is to be operated when the copying speed of the copier is low and constant, it is only necessary to just set up the copier for the sorter mode.

In a printer and particularly in a mimeographic printing machine, after the printing making of the original to be printed is finished and then a master or a mimeographic stencil is wound on the outer circumferential surface of a drum, it is possible to set up the print speed freely so that a great number of prints can be made in a short time. Then the sorting of the printed sheets to be discharged from the machine will be performed by a separate sorter as connected with the machine, at need.

With the conventional printers, although the timing of moving the bins is variable to meet the maximum print speed of the printer, it was difficult to insert the printed sheets into the individual bins at a speed beyond the print speed.

Specifically, though the individual bins could move to conform with the printing at a speed higher than the predetemined print speed, this overspeed movement of the bins drove the printed sheets outside the receiving region of the individual bin. Yet even if the printed sheets could be received in the bin, their edges could not be trued up within the receiving region of the bin.

As a consequence, the operator had to grope a suitable print speed for use with the sorter, which was fairly laborious.

SUMMARY OF THE INVENTION

With the foregoing problems in view, it is an object of this invention to provide a mimeographic printing machine, selective in print speed and equipped with a sorter, in which printed sheets can be sorted stably at all times without adjusting the timing of movement of bins of the sorter.

According to a first aspect of the invention, there is provided a mimeographic printing machine equipped with a sorter for moving a plurality of bins to sort printed sheets, comprising:

(a) speed set-up means for setting up a desired print speed;

(b) sorter mode set-up means for setting up the sorter for the sort mode; and (c) control means for changing the print speed, which is set up by said speed set-up means, to a predetermined print speed so as to conform to the sorting of the sorter, when the sort mode is set up in said sorter mode set-up means.

According to a second aspect of the invention, there is provided a mimeographic printing machine comprising:

(a) a sorter for moving a plurality of bins to sort printed sheets;

(b) speed set-up means for setting up a desired print speed;

(c) sorter mode set-up means for setting up said sorter for the sort mode; and (d) control means for changing the print speed, which is set up by said speed set-up means, to a predetermined print speed so as to conform to the sorting of the sorter, when the sort mode is set up in said sorter mode set-up means.

According to a third aspect of the invention, there is provided a mimeographic printing machine comprising:

(a) a sorter for moving a plurality of bins to sort printed sheets;

(b) speed set-up means for setting up a desired print speed;

(c) sorter mode set-up means for setting up said sorter for the sort mode;

(d) control means for changing the print speed, which is set up by said speed set-up means, to a predetermined print speed so as to conform to the sorting of the sorter, when the sort mode is set up in said sorter mode set-up means; and (e) feed means for feeding the printed sheets to said sorter.

In operation, upon depression of the sorter mode key, printed sheets will be discharged as sorted into the individual bins of the sorter connected to the mimeographic printing machine.

In the mimeographic printing machine, the print speed may be set up for an optional value; a CPU will set up this value for a predetermined print speed at which the printed sheets are to be discharged. The print speed data automatically set up in response to depression of the sorter mode key are previously stored in the memory means as a print speed such that the printed sheet fed from the mimeographic printing machine will be received in the individual bins of the sorter reliably and orderly.

When using the sorter, the operator can do sorting stably at all times simply by setting up the sorter mode, without adjusting the print speed to meet the sorter.

BRIED DESCRIPTION OF THE DRAWINGS

DETAILED DESCRIPTION

A preferred embodiment of this invention will now be described in detail with reference to the accompanying drawings.

Figure 1:
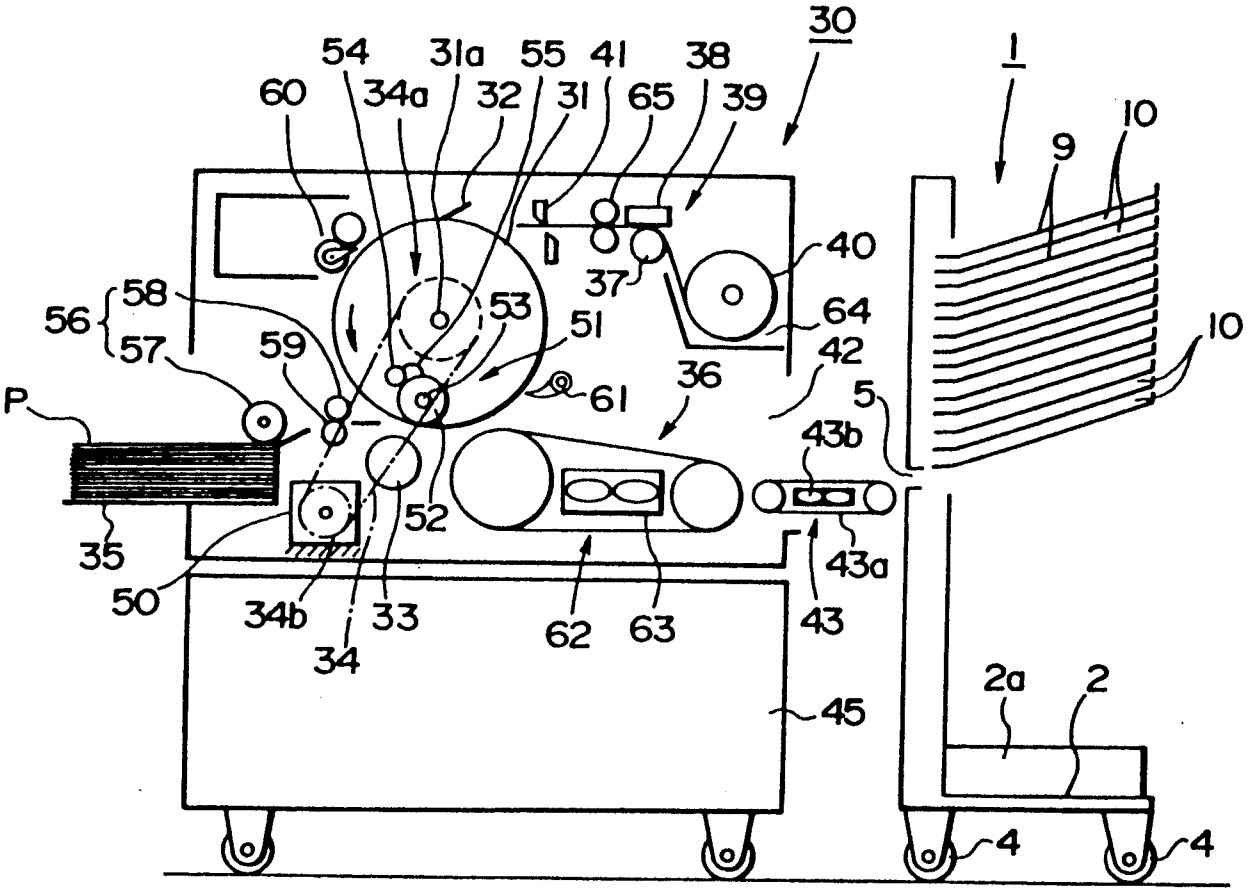
FIG. 1 is a diagram of a mimeographic printing machine of this invention, showing the machine as connected with a sorter.

FIG. 1 is a schematic view of a mimeographic printing machine of the invention, showing the machine as connected with a sorter.

In FIG. 1, reference numeral 30 designates the whole of the mimeographic printing machine, and 1, the whole of the sorter. In the mimeographic printing machine 30, a tubular printing drum 31 is rotatably supported by a non-illustrated frame for rotation about its axis 31*a*. The printing drum 31 is porous and has on its outer circumferential surface clamp means 32 for clamping one end of a mimeographic stencil master 40.

Further, the printing drum 31 is connected to and driven by a sprocket 34*a* coaxial with the axis 31*a*. The sprocket 34*a* is connected to and driven by a driving sprocket 34*b* of a printing drum drive motor 50 via an endless belt 34. By this power transmission unit, the printing drum 31 can be intermittently or continuously rotated counterclockwise in FIG. 1 by the printing drum drive motor 50.

A print ink supplier 51 is situated inside the printing drum 31 so as to be in contact with the inner circumferential surface of the printing drum 31. The print ink supplier 51 includes a squeegee roller 52 rotatable about its own axis 53, and a doctor roller 54 extending along the generation line of the squeegee roller 52 with a predetermined gap with respect to the outer circumferential surface of the squeegee roller 54. The squeegee roller 52 is rotated in the same direction as the rotation of the printing drum 31 in synchronism therewith to supply print ink of an ink pool 55 to the inner circumferential surface of the printing drum 31.

Specifically, in response to the rotation of squeegee roller 52, the print ink of the ink pool 55 passes through the gap between the squeegee roller 52 and the doctor roller 54, during which time the moving ink is measured and forms a uniform thickness of print ink layer on the outer circumferential surface of the squeegee roller 52. As the squeegee roller 52 rotates, this print ink layer is then supplied to the inner circumferential surface of the printing drum 31.

Reference numeral 33 designates a pressure roller for pressing a print paper sheet P against the printing drum 31.

A paper supply table 35 is vertically moved by a non-illustrated drive unit mounted thereon. The extent of vertical movement of the paper supply table 35 depends on the height of stack of print sheets P set on the paper supply table 35.

A paper feed unit 56 described below generally comprises a paper feed roller 57 such as of rubber, a guide roller 58 and a timing roller 59. A print paper sheet P picked up from the top of print sheet stack on the paper supply table 35 by the paper feed roller 57 is conveyed toward the guide roller 58 by the paper feed roller 57 and is then temporarily held in a predetermined loop shape between the guide roller 58 and the timing roller 59.

Further, around the printing drum 31, there are a stencil master removal and disposal unit 60 situated upwardly of the paper supply table 35, and a printed-paper sheet separator claw 61 situated in confronting relation to the paper feed unit 56. The separator claw 61 serves to remove the printed sheet from the printing drum 31, and the removed sheet will be conveyed toward the sorter 1 by the paper sheet discharge unit 36.

The paper sheet discharge unit 36 includes a belt conveyer 62 and a suction device 63; the printed paper sheet removed from the printing drum 31 by the separator claw 61 conveyed toward the sorter 1 by the belt conveyer 62 while the printed paper sheet is being sucked by the suction device 63.

Situated upwardly of the paper sheet discharge unit 36 is a stencil master reservoir 64 for stocking a continuous length of mimegraphic stencil master 40 wound in roll.

A master making unit 39 is situated between the stencil master reservoir 64 and the printing drum 31. The master making unit 39 includes a thermal head 38 and a platen roller 37 confronting the thermal head 38. A mimeographic stencil master 40 is supplied from the stencil master reservoir 64 to the master making unit 39 where the master making of the mimeographic stencil master 40 is performed by thermal recording. The thermal head 38 is composed of a plurality of heat generating elements arranged at regular distances in a row, i.e. in the horizontal scanning direction. The heat generating elements selectively generate heat according to image data signals read by a non-illustrated reading unit.

The master stencil made by the master making unit 39 is conveyed toward the printing drum 31 by a pair of master conveyer rollers 65. A cutter 41 is situated between the master making unit 39 and the master drum 31 for cutting the master stencil when the latter is wound on the outer circumferential surface of the master drum 31 to a predetermined extent.

The sorter 1 to be connected with the mimeographic printing machine 30 has the following structure.

The mimeographic printing machine 30 has a sheet discharge port 42 which is to be located at a height corresponding to a paper sheet inlet 5 of the sorter 1 when the mimeographic printing machine 30 is installed on a base 45. A sheet conveyer unit 43 is situated between the sheet discharge port 42 of the mimeographic printing machine 30 and the paper sheet inlet 5 of the sorter 1 for conveying a printed sheet, which is discharged from the sheet discharge port 42 of the mimeographic printing machine 30, toward the paper sheet inlet 5 of the sorter 1.

The paper sheet conveyor unit 43, like the sheet discharge unit 36, includes a belt conveyor 43*a* and a suction device 43*b*; the printed sheet transferred from the paper sheet discharge unit 36 is conveyed toward the paper sheet inlet 5 of the sorter 1 by the belt conveyor 43*a* while the printed sheet is being sucked by the suction device 43*b*.

The sheet conveying speed of the sheet conveyor unit 43 is set up for a speed such that the printed paper sheets conveyed from the sheet conveyor unit 43 are inserted exactly and orderly into the individual bins 9 of the sorter 1, thus realizing stable sorting. The print speed at this time is set up for such a speed that the successive printed sheets discharged from the printing machine 30 are conveyed to the sheet conveyor unit 43 smoothly without overlapping one another on the sheet conveyor unit 43, thereby streamlining the discharge and sorting of the printed sheets.

Figure 2:
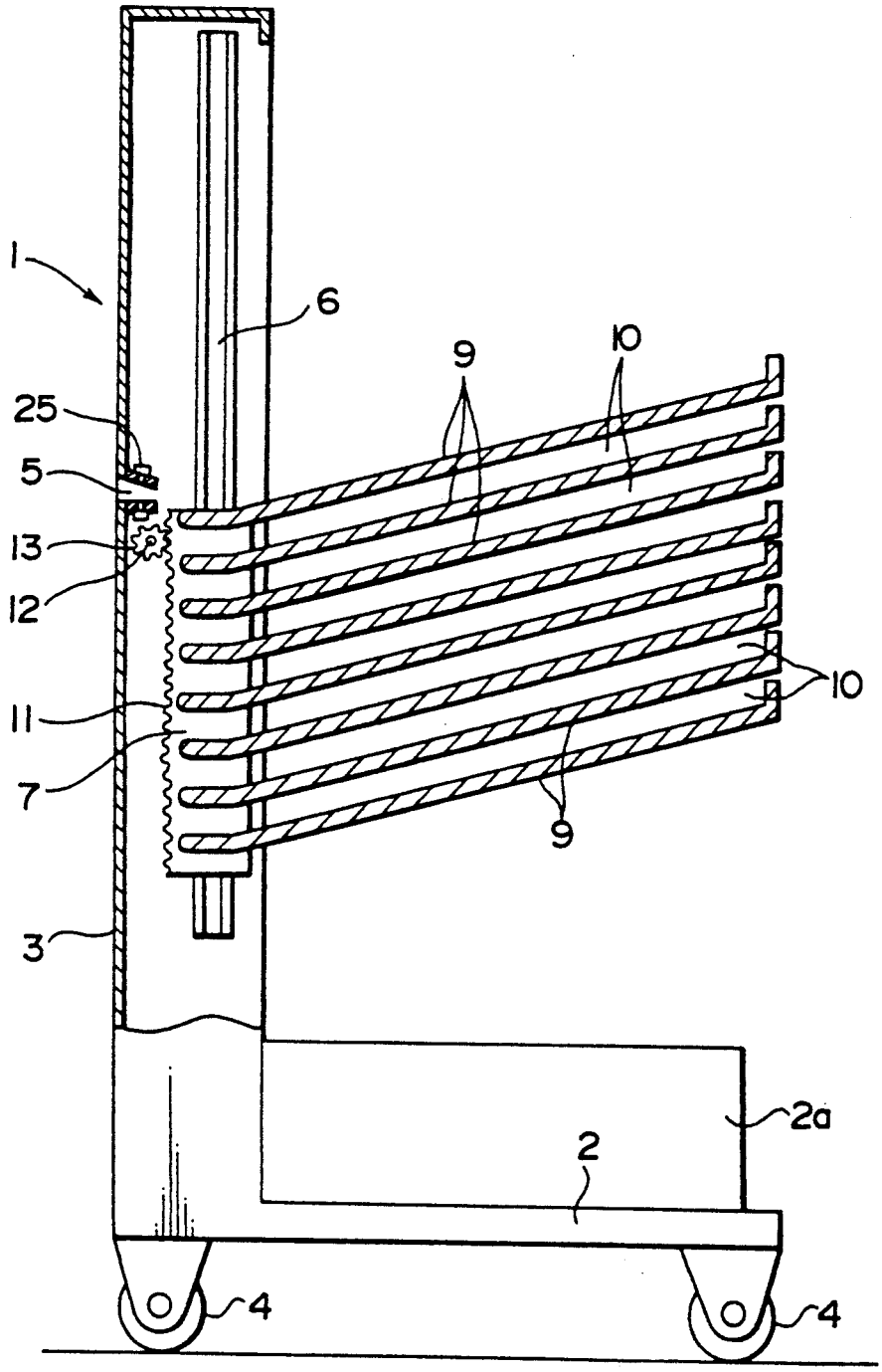
FIG. 2 is a cross-sectional of the sorter connected to the mimeographic printing machine.

FIG. 2 is a sectional view of a sorter connected with the mimeographic printing machine.

The sorter 1 is supported on a base 2 having casters 4, there being a vertical post 3 at one end of the base 2. The post 3 has a paper sheet inlet 5 at a medium height. A sensor 25 is attached to the post 3 for detecting the passage of a printed sheet through the sheet inlet 5. The post 3 also has a guide rail 6 extending vertically.

The guide rail 6 extends crossing a position corresponding to the paper sheet inlet 5, and a slider 7 is slidably mounted on the guide rail 6.

A plurality of plate-like bins 9 are attached to the slider 7 at predetermined distances. The adjacent bins 9 define therebetween gaps 10; as the slider 7 is guided vertically along the rail 6, a selected one of the gaps 10 is brought into alignment with the sheet inlet 5.

The slider 7 has a rack 11 with which a driving pinion 13 rotatably mounted on the post 3 by a pivot 12 is in meshing engagement. The driving pinion 13 is selectively rotated by a motor 20 in a drive control box 2a on the base 2 to move the slider 7 between the uppermost position and the lower position in which the uppermost bin 9 is aligned with the paper sheet inlet 5, as shown in FIG. 2, in terms of inter-bin gaps.

The sorting of printed paper sheets into the individual bins 9 of the sorter 1 connected with the mimeographic printing machine 30 is started by depressing a particular key (described below) on the operating panel of the mimeographic printing machine.

Figure 3:
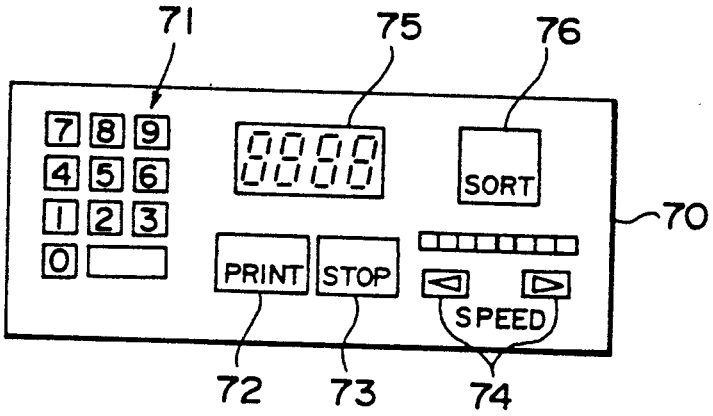
FIG. 3 is a view showing an operating panel of the mimeographic printing machine.

FIG. 3 shows an operating panel 70 equipped with the mimeographic printing machine 30. On the operating panel 70 there are provided, for example, ten-keys 71 for setting up the number of sheets to be printed, a print start key 72 for giving off an instruction to start printing, a print stop key 73 for stopping printing, print speed set-up keys 74 for setting up a print speed, a display 75 such as of an LCD for displaying the number of sheets set up, etc., a sorter mode key 76 for instructing the sorter, which is connected with the mimeographic printing machine 30, to sort printed paper sheets.

Figure 4:
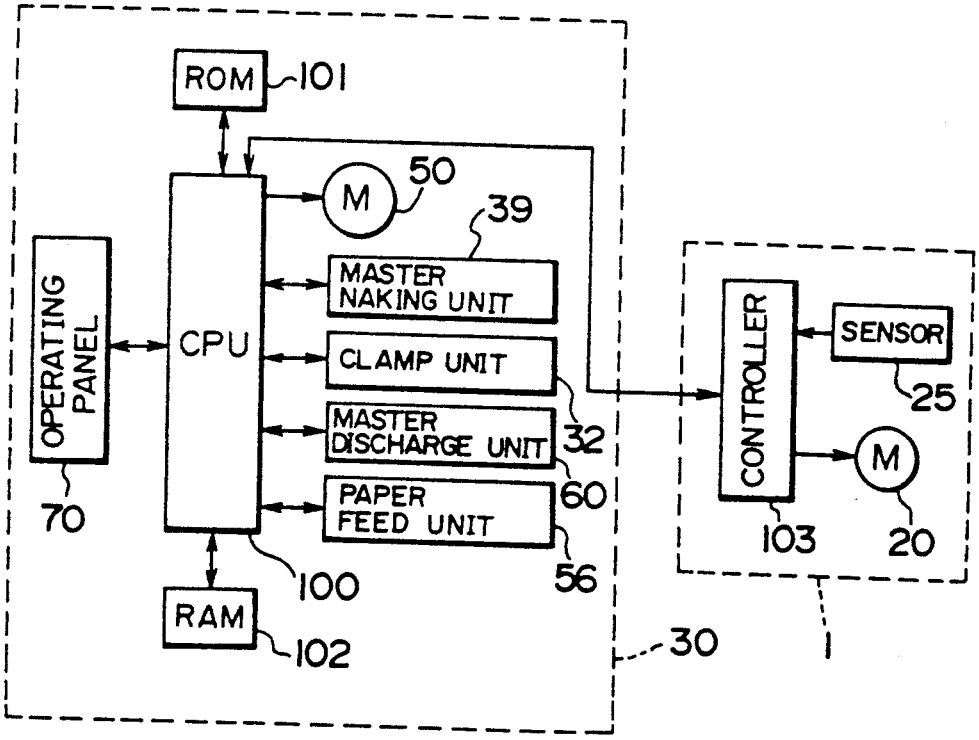
FIG. 4 is a block diagram showing the electrical connections of the mimeographic printing machine.

FIG. 4 is a block diagram showing the electrical connections of the mimeographic printing machine 30.

In FIG. 4, to a CPU 100 in the form of a control means such as a microprocessor, there are connected a ROM 101 in which a program for controlling various parts in the machine is stored, the operating panel 70, the master drum drive motor 50, the paper feed unit 56, the clamp means 32, the stencil master removal and disposal unit 60, the master making unit 39, and a RAM 102 for temporarily storing the arithmetic result of the microprocessor and for storing on occasion data about the set-up number of sheets to be printed, which data is input by the ten-keys 71 of the operating panel 70, or print speed data and the status of set-up when setting up for each mode.

As shown in FIG. 4, the mimeographic printing machine 30 and the sorter 1 are electrically connected with each other. A controller 103 on the sorter side performs communications of various signals between the mimeographic printing machine 30 and the CPU 100, controls the motor 20 to rotate the driving pinion 13 to thereby move the slider 7 vertically, and sorts the printed sheets from the mimeographic printing machine 30 into the individual bins.

Further, when jamming of a printed sheet conveyed from the mimeographic printing machine 30 is detected on the sorter side, the controller 103 of the sorter 1 sends to the mimeographic printing machine 1 a signal indicating the jamming, whereupon the mimeographic printing machine 30 will stop printing. At that time, if the sensor 25 does not detect the trailing end of the printed sheet after the lapse of a predetermined time from when it detected the leading end of the same sheet, the controller 103 will conclude that jamming has occurred.

Figure 5:
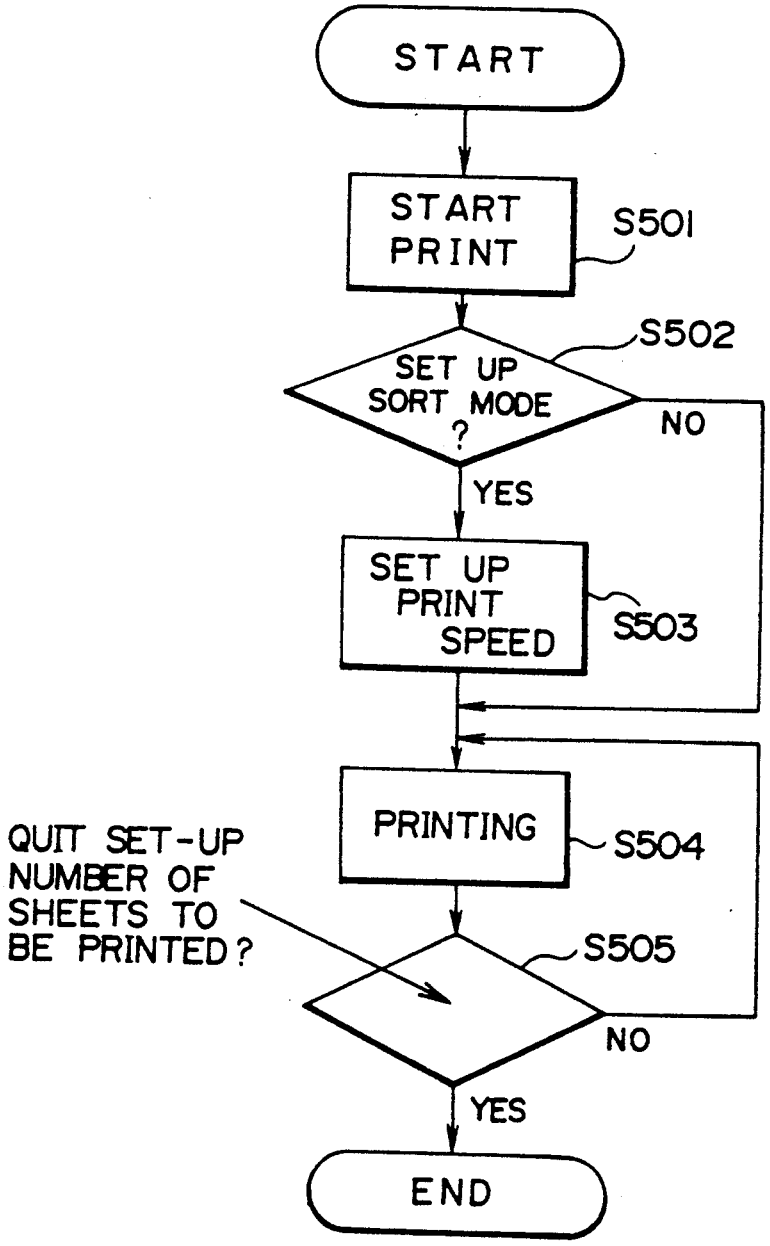
FIG. 5 is a flow diagram showing sequential steps of printing procedure of the mimeographic printing machine.

The procedure of printing of the mimeographic printing machine will now be described with reference to FIG. 5.

The description on the procedure until the mimeographic stencil master 40 made by the master making unit 39 according to the image signals read by a non-illustrated reading unit is wound on the outer circumferential surface of the printing drum 31, is omitted here for clarity.

For preparation of printing, data about the number of sheets to be printed is input by the ten-keys of the operating panel 70, and also data about the print speed is input by the print speed set-up keys 74, whereupon the print start key 72 is depressed to start the printing.

These input data are then stored in the respective areas of the RAM 102 as the individual printing conditions. Now by depressing the sorter mode key 76, it is possible to perform the sorting operation using the sorter 1. In this case, data indicating that the sorter mode has been set up is stored in a particular area of the RAM 102.

In the foregoing conditions, when the print start key 72 is depressed (Step 501), the CPU 100 first of all will discriminate from the status of the RAM 102 whether or not the sorter mode is set up (Step 502).

If the sorter mode is set up, the print speed data now stored in the RAM 102 will be read and will be set up again for a predetermined print speed (Step 503).

For example, if the print speed data to be input by the print speed set-up keys 74 is 100 sheets/minute (100 r.p.m.), which exceeds the upper threshold, it will be substituted by 60 sheets/minute (60 r.p.m.), which is a predetermined print speed. As a matter of course, if the print speed data to be input by the print speed set-up keys 74 is equal to or less than 60 sheets/minute, it is unnecessary to change the print speed data.

This predetermined print speed is a speed such that the printed sheets conveyed via the paper sheet discharge unit 36 can be smoothly transferred to the sheet conveyer unit 43 which is set up for such a conveying speed that these printed sheets can be sorted exactly and orderly into the individual bins 9 of the sorter 1, thus securing stable sorting. This speed is previous stored in the ROM 101; the CPU 100 as the control means will make a matching check and discrimination between the previously stored print speed data and the input print speed data and will then change the latter data if necessary.

Then the printing operation will be performed based on the data about the number of sheets to be printed, which data is stored in the RAM 102, and the print speed previously set up by the sorter mode set-up keys 74 (Step 504).

If it is deemed in the step 504 that the sort mode is not set up, the printing operation will be performed based on the data about the number of sheets to be printed, which data is input first and stored in the RAM 102, and the print speed data (Step 504).

During the printing, the master drive motor 50 for rotating the printing drum 31 will be controlled based on the print speed data stored in the RAM 102.

Thus based on the data stored in the RAM 102, the printing drum 31 and the pressure roller 33 will be driven and, at the same time, the paper feed unit 56 and the print ink supplier 51 as well as the associated parts will be activated.

Subsequently, the printed sheet will be removed from the printing drum 31 by the separator claw 61 and then conveyed toward the sorter 1 by the paper sheet discharge unit 36. This printing procedure will be continued until the number of printed sheets reaches the preset value (Step 505).

The individual printed sheet conveyed from the mimeographic printing machine 30 is then conveyed toward the sheet inlet 5 of the sorter 1 by the sheet conveyer unit 43. The printed sheet will pass the sheet inlet 5 and will be received in the bin 9 aligned with the sheet inlet 5. At that time, if the sensor 25 detects that the printed sheet has been received in the bin 9, the controller 103 the motor 20 to move the slider downwardly from the uppermost position to a lower position in which the bin 9 for the next printed sheet is aligned with the sheet inlet 5.

This procedure will take place every time the sensor 25 detects a printed sheet.

In the present embodiment, as shown in FIG. 2, the bin 9 is moved from the uppermost position to the lowermost position, i.e. the home position, in which the bin 9 is aligned with the sheet inlet 5. Every time a printed sheet is received in the individual bin 9, the bins 9 will be moved downwardly.

If the number of printed sheets exceeds the number of bins 9 of the sorter 1, the excessive printed sheets will be discharged onto the uppermost bin 9.

In the normal printing operation, in which the sorter mode is not set up, all of the printed sheets will be discharged onto the uppermost bin.

With the mimeographic printing machine of this invention, since, if the sorter mode set-up means sets up the mode for using the sorter, the control means controls so as to set up the print speed, for succeeding sheets, depending on the status of set-up of the mode set-up means, it is possible to perform the sorting operation stably at all times simply by setting up the mode by the operator, without adjusting the print speed to meet the sorting operation of the sorter, which is laborious.

What is claimed is:

1. A mimeographic printing machine equipped with a sorter for moving a plurality of bins to sort printed sheets, comprising:

(a) speed set-up means for setting up a desired print speed;

(b) sorter mode set-up means for setting up the sorter for the sort mode; and (c) control means for changing the print speed, which is set up by said speed set-up means to a predetermined print speed so as to conform to the sorting of the sorter, when the sort mode is set up in said sorter mode set-up means.

2. A mimeographic printing machine according to claim 1, wherein said control means includes:

(a) first memory means for storing the print speed data set up by said speed set-up means;

(b) second memory means for storing the predetermined print speed data conforming to the sorting of the sorter; and (c) a controller for discriminating whether or not the sort mode is set up and for controlling various printing mechanisms so as to perform the printing based on the predetermined print speed data, which is stored in said second memory means, if the sort mode is set up, and based on the set-up print speed data, which is stored in said first memory means, if the sort mode is not set up.

3. A mimeographic printing machine comprising:

(a) a sorter for moving a plurality of bins to sort printed sheets;

(b) speed set-up means for setting up a desired print speed;

(c) sorter mode set-up means for setting up said sorter for the sort mode; and (d) control means for changing the print speed, which is set up by said speed set-up means, to a predetermined print speed so as to conform to the sorting of the sorter, when the sort mode is set up in said sorter mode set-up means.

4. A mimeographic printing machine according to claim 3, wherein said sorter includes a drive for moving said bins and a controller for controlling said drive, said controller being operable to control said drive so as to sort the printed sheet in order to the individual bins, if the sort mode is set up in said sorter mode set-up means, and to insert the printed sheets into a specified one of said bins, if the sort mode is not set up in said sorter mode set-up means.

5. A mimeographic printing machine comprising:

(a) a sorter for moving a plurality of bins to sort printed sheets;

(b) speed set-up means for setting up a desired print speed;

(c) sorter mode set-up means for setting up said sorter for the sort mode;

(d) control means for changing the print speed, which is set up by said speed set-up means, to a predetermined print speed so as to conform to the sorting of the sorter, when the sort mode is set up in said sorter mode set-up means; and (e) feed means for feeding the printed sheets to said sorter.

6. A mimeographic printing machine according to claim 5, wherein the sheet feed speed of said feed means is determined so as to conform to the sorting of said sorter.

* * * * *